United States Patent [19]

Domokos

[11] Patent Number: 4,521,455

[45] Date of Patent: Jun. 4, 1985

[54] PROCESS AND EQUIPMENT FOR THE PRODUCTION OF ALLOYED COPPER WIRE ROD BY CONTINUOUS CASTING

[75] Inventor: Sipos Domokos, Budapest, Hungary

[73] Assignee: Csepel Muvek Femmuve, Csepel, Hungary

[21] Appl. No.: 459,415

[22] Filed: Jan. 20, 1983

[30] Foreign Application Priority Data

Feb. 23, 1982 [HU] Hungary ..... 536/82

[51] Int. Cl.[3] ..... B05D 3/12; B05C 3/02

[52] U.S. Cl. ..... 427/178; 427/431; 427/432; 427/434.7; 427/436; 118/405; 164/268

[58] Field of Search ..... 427/178, 116, 117, 431, 427/432, 434.7, 436; 164/55.1, 57.1, 268, 448, 461; 266/120; 118/405, 420, DIG. 19; 29/527.2, 527.3, 527.5, 527.7

[56] References Cited

U.S. PATENT DOCUMENTS

| | | | |
|---|---|---|---|
| 3,510,345 | 5/1970 | Marchant | 427/432 |
| 3,836,360 | 9/1974 | Bray | 75/135 |
| 3,916,979 | 11/1975 | DeGois et al. | 164/57.1 |
| 3,995,679 | 12/1976 | Brinkmann et al. | 164/86 |

*Primary Examiner*—Norman Morgenstern
*Assistant Examiner*—Ken Jaconetty
*Attorney, Agent, or Firm*—Murray Schaffer

[57] ABSTRACT

An alloyed copper wire rod is formed by continuous rod-casting, wherein a core rod is driven through a crucible containing molten metal. High purity copper melt is continuously charged into the crucible; to which an alloying material is simultaneously added in a quantity which corresponds to the given casting speed of the core rod. The required alloy thus obtained is crystallized on the surface of the core-rod as it passes through the crucible and the rod produced is treated in the usual manner i.e., cooling, rolling and coiling.

9 Claims, 1 Drawing Figure

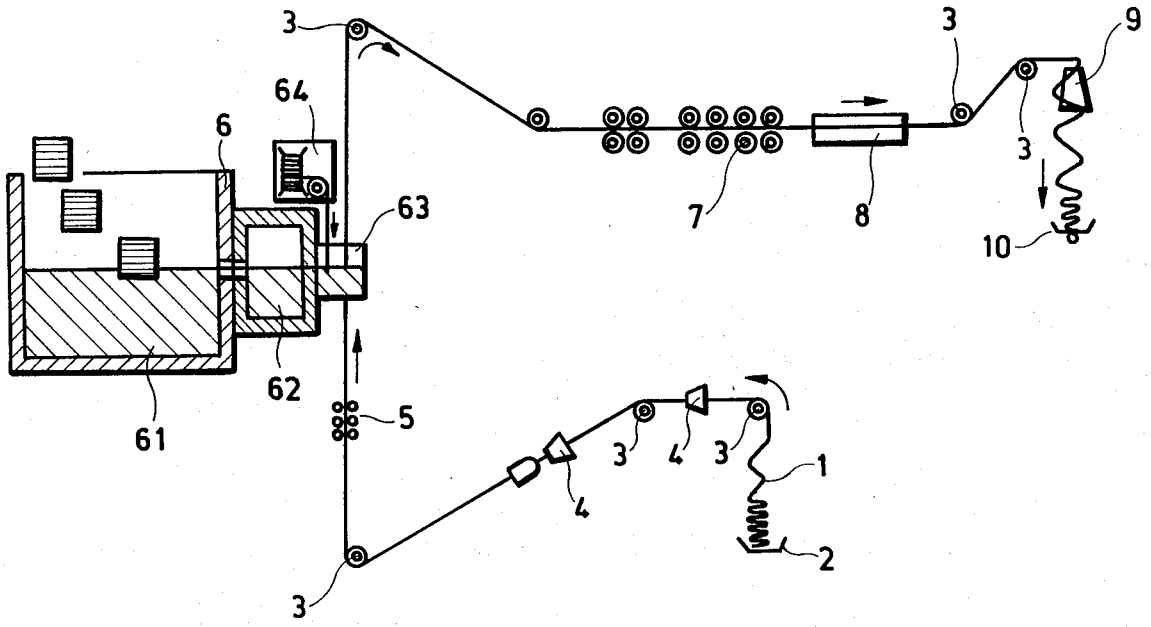
9
3
10
3
8
7
3
64
6
63
62
61
5
3
1
2
3
4
3
4
3

PROCESS AND EQUIPMENT FOR THE PRODUCTION OF ALLOYED COPPER WIRE ROD BY CONTINUOUS CASTING

BACKGROUND OF THE INVENTION

The present invention relates to a method and apparatus for the production of alloyed copper rod by continuous rod-casting.

There is a continuously increasing demand—in respect to both quality and quantity—on the part of the consumers for electric cables, wirings and components made of copper wires of high purity and excellent electric properties. It is well known from practice that pure copper is not suitable for certain purposes. As a consequence, low-alloyed copper wires are produced for special purposes where the alloying contents are between 0.05–1.5%. These alloyed copper wires are mostly used in cases, in which beside the proper electric conductivity other requirements are also to be met, as for example; where the wire is subjected to high wearing it has to be wear-resistant; where profiled work pieces are being produced, machinability is important; and where subject to high mechanical or thermal stresses, a proper tensile strength is required.

It is a well known fact that a Cu-Ag alloy of 0.05–0.1% Ag,—due to its high softening point and good creep strength after cold working—is well suitable for manufacturing commutator segments, transistor bases and welding electrodes. Due to its excellent cold working characteristics and drawability, a Cu-Sn alloy of 1.25% Sn is most suitable for the production of components for switches, fuse-elements and diaphragms. In addition to its good electric and heat conductivity, a Cu-Cd alloy has excellent tensile strength and hardness; and where such alloy has Cd content of between 0.5 and 1.5% it is the best one for use under high wearing conditions. Cu-Cd alloys are used for producing overhead lines, connections, electrodes, current conducting rings and rails. A Cu-Pb alloy with 1% Pb-content may be best suited—due to its good workability and machinability—for the production of screws, connecting elements and components of motors and switches. At last, due to its good electric conductivity, and the excellent tensile strength at high temperature and in particular, due to its workability a Cu-Zr alloy of 0.1–0.2% Zr content can be used, for collector rings, current leading axles, transformers to be operated at a high temperature, as well as for the jaws of butt welding machines.

Besides the applications and possibilities listed above further requirements are demanded for rods of diameter 8–12 mm—to be processed in high speed drawing machines at the up-to-data cable works. Such requirements are the homogenity and chemical purity of the wires. The total quantity of the undesired impurities—beyond the oxygen content and the contained alloying element—must not be more than 80 ppm. A further important requirement is that the wire must be free of all kinds of physical defects, such as inclusions, cracks and rolling defects, and at the same time the surface of the wire to be processed must be bright. Finally, a most important requirement is that the wire should be available in coils of a weight of at least 2000 kg and it should be soft and well drawable. The alloyed copper wire rods are partly produced by wire bar rolling traditionally or by continuous casting and rolling.

With the traditional technology, the alloy is produced in induction furnaces, in certain cases under vacuum or protective gases. The next phase includes the casting of the round ingots into watercooled casting moulds. After cooling, the feeder of the ingot is cut and the material needed for rolling is prepared by hot-pressing. Thereafter the rod is hot rolled to the required diameter, coiled into coils and if it is necessary the coils are pickled. In the course of the manufacturing steps previously described, the material has to be heated and cooled, respectively, in the three distinct operational phases, i.e. melting, pressing and rolling. The energy consumption needed for each of these phases, makes the production very uneconomical and the waste material formed in the process decreases the material yield as well. A further drawback of the traditional production lies in the fact that the weight of the coils produced is not more than 100 to 150 kg, which is not in compliance with the requirements of modern cable producing machines. Due to the small weight of the coils the number of the welded joints increases, resulting in a further source of defects in processing.

A further drawback lies in the fact that the surface of the wires produced is not bright and as a consequence the wire has to be pickled.

The continuous casting of rods and production of the alloyed wire rod by hot-rolling represents the most modern technology known up to now. With this technology the metal is melted in an induction furnace, thereafter the melt is cooled in a graphite die in vertically or horizontally arranged equipment. Depending on the type of the alloy the rods—generally with a diameter of 20 to 30 mm—are wound into coils weighing about 2000 Kg. After having been heated, rolled and pickled the wire coils are ready for use in cable-works. The costly technology, and the high oxygen content of the rods as well as difficulties connected with the usage of graphite dies have a negative influence on the economy and the efficiency of the production.

A technology for the production of copper wire rods of oxygen free and high purity—called dipforming process—is also known. A pure copper wire, the so-called core-wire, is driven through the molten copper, the liquid copper is cooled down, crystallizing on the surface of the core-wire, while the temperature of the core-wire is increased to the ambient temperature. After pre-cooling and hot rolling the obtained rod is cooled in a closed emulsion system and finally wound to coils weighing 2500 to 3500 kp. According to this technology a part of the energy needed for melting is used for rolling. No further heating is needed in the process. Oxygen free, high purity copper cathode of 99.99% Cu-content produced by electrolyses is the raw material of the process. The quality of the cathode is protected by a charcoal layer in the furnace system and an inert protective gas in the entire technological system.

This process, using the technology of casting rolling is a really economical continuous production of the copper wire rods. In spite of this fact it has not been applied for the production of the different alloyed copper wires. The reason for this is, that the furnace system—just to ensure the continuous casting, contains a relatively large quantity of molten metal. In producing alloyed copper wire the entire metal quantity has to be alloyed in order to obtain the necessary composition and this entire quantity will be wasted when changing alloying material. The metal contaminated by the previous alloying element has to be discharged from the system, and a charge according to the new alloying composition has to be melted.

The aim of the present invention is to develop a process for the production of alloyed copper wire of different kinds keeping all the benefits of the dip-forming process presently used for the production of oxygen free copper wire rod and making the process suitable for continuous production of alloyed copper wires in optional quantity, practically without material loss and permitting a change of alloy without influence on the production of high purity oxygen free copper wire rods.

SUMMARY OF THE INVENTION

Accordingly, the invention relates to a process for producing alloyed copper wire rod by continuous casting in the course of which the molten metal contained a crucible connected to an integrated furnace, crystallizes on the surface of a core-rod which is passed through the crucible. The rod thus obtained is hot-rolled, cooled and coiled.

The essence of the invention lies in the continuous charging, from the furnace system of a copper melt of high purity, into the crucible while simultaneously admixing to the melt the alloying material in a quantity corresponding to the given casting speed, thus obtaining the alloy required. The alloy is crystallized on the core rod, and the casted rod is thereafter treated, in the known manner and wound-up into coils.

According to the invention it is advantageous, if the alloying material is charged in form of a wire into the crucible.

According to the invention it is also advantageous if the alloying material is charged into an annealed copper pipe of high purity and this is driven into the crucible.

According to the invention the process is based on a simple and surprising recognition, that it is superfluous to contaminate a copper melt of high purity in the furnace system itself, and that it is sufficient only to charge the alloying material into the copper melt of high purity in the crucible at a speed corresponding to the casting speed.

The invention also relates to the equipment for performing the process according to the invention, consisting of a furnace system, a crucible connected thereto, a drive for forwarding the rod driven through the crucible, a cooling zone, a mill stand and a coiling machine.

The essence of the equipment according to the invention is that the crucible is provided with a loader for the introduction of the alloying material.

According to the invention it is advantageous that the crucible loader is synchronized with the drive forwarding the core-rod.

Further, according to the invention it is also advantageous that the loading rate of the crucible, at which the alloying material is introduced can be linearly changed within the range from 0.01 to 0.5 m/sec.

Also, a further advantage is that the crucible is connected to the furnace system in a replaceable manner.

The main advantage of the invention is that compared to the known processes, the product thus obtained completely meets the qualitative requirements of the modern cable producing machines for the low-alloyed copper wires, in particular with respect to the surface finish, homogenity and the weight of the coils. It is to be considered as an advantage that the application of the process does not require high investment costs or separate equipments. Further advantage of the process is that the wire-coils of optional alloy can be produced without significant material waste.

BRIEF DESCRIPTION OF THE DRAWING

The invention will be described in detail by means of an example, the enclosed drawing shows the schematic arrangement of the equipment according to the invention.

DESCRIPTION OF THE INVENTION

Essentially the equipment comprises a roller conveyor 2 storing the core-rod 1 in coils, the straightening rollers 3, the devices (tools) 4 for drawing and shaving the core-rod 1, as well as the cold section containing the drives 5, the hot section containing the integrated electrical furnace system 6 and the rolling mill 7. A water cooling-zone 8, followed by a coiler 9 and the final section formed of the turntable 10 for taking up the wire coil follows the mill 7.

In the description of embodiment illustrated here, the furnace system 6 includes an induction melting furnace 61, an induction holding furnace 62 and a crucible 63 connected to the holding furnace 62 by means of a launder tube. The crucible 63 receives the core-rod 1 arriving from the cold section 5 and enables the molten metal to be crystallized on the surface of said core-rod. The molten metal is replaceable and crucible 63 is connected in a simple way to the holding furnace 62. In addition to this, the crucible 63 is provided with a loader 64 by which loading of the alloying material is affected. The rate of loading through the loader 64 can be linearly varied in the range between 0.01 and 1.5 m/sec.

A copper cathode of 99.99% Cu-content is loaded into the melting furnace 61 by means of a loader having a vacuum-lift which is not illustrated here. Loading is controlled by the metal level in the crucible 63 and the holding furnace 62 is connected to the crucible. In the melting furnace 61 and the holding furnace 62 metal is protected against oxydization by means of charcoal layer or protective gas (not illustrated here).

In course of operation the core-rod 1 is placed onto the roller-conveyor 2; the beginning of the wire is welded to the end of the previous core-rod by means of a butt welding machine. Thereafter the core-rod 1 is allowed to pass through the drawing-shaving devices 4, where the required diameter is obtained. The core-rod of proper size is introduced by means of the drive 5 into the crucible 63.

In the crucible 63 to core-rod 1 is heated by the metal contained therein, while the metal crystallizes on the surface of the rod. The tensile strength of the rod leaving the crucible with a temperature of about 1063° C. is low, accordingly it cannot be formed by any kind of forming process. For this reason the rod is cooled to the temperature of 800° C. in a cooling chamber not illustrated here.

Rolling of the wire to the final diameter is made in the rolling mill 7, which is advantageously of a tandem-system. The speed of the working rolls are controlled by means of an electronic control system having an automatic speed control and digital display. Thereafter the wire is cooled in the cooling section 8, preferably formed as a cooling pipe, to 40° C., the cooled wire is wound by means of the coiler 9 on the turntable 10.

If it is desired to produce a copper alloy containing 0.1% Ag, a silver wire $\phi$ 2 mm of industrial purity (99.9%) is strung on the loader 64 from which it is spooled into the crucible 63. The speed of the direct-current motor operating the load is adjusted so, as to obtain a linearly changing loading rate between 0.01 and 0.5 m/sec towards the crucible 63. The loader of the alloying material is designed so, that the introduction of the alloying wire into the crucible can also take place under a protective atmosphere. After initiating the usual operation of copper wire rod production, and when beginning to use the coil of the alloyed core-rod 1, the alloy material is loaded at a high speed by means of the loader 64, until the molten metal in the crucible 63 reaches an Ag-content of 0.1%. Thereafter the loading rate of the alloying Ag-wire is decreased to the value corresponding to the casting speed by adjusting the speed of the loader 64. Simultaneously with the adjustment of the final loading rate of the alloy the other production parameters are also adjusted, as for example, the water quantity in the cooling zone 8, casting rate, tilting angle (flow rate) of the integrated furnace system 62, melting rate, the level of the molten metal in the crucible 63, as well as rolling temperature 7, etc. After having been cooled in the cooling zone 8, the alloyed wire is coiled on the turntable 10, by means of the coiler 9.

If it is desired to produce an oxygen-free alloyed copper wire rod of 1% Cd-content, we proceed according to the previous example; in compliance with the higher percent content of alloying material in the cadmium bronze wire, the loader 64 is adjusted to a feeding rate between 0.1–1.5 m/sec. Preferably the alloying material in this case is prepared in such a manner that an annealed capillary copper pipe of high purity is filled with Cd-powder; the Cd is loaded together with the copper pipe into the crucible 63 under a protective gas, the loading rate corresponds to the casting speed. Thereafter the procedure is as previously described, with the difference, that the electric output of the equipment heating the crucible 63 is increased by the energy quantity needed for melting the copper pipe and Cd introduced into the metal.

The crucible 63 according to the invention is designed with replaceable dimensions and can be connected to the holding furnace 62 with a simple mechanical connection.

What we claim:

1. A process for the continuous casting of a copper alloy wire rod comprising the steps of simultaneously:

(a) charging a continuous flow of molten pure copper into a crucible;

(b) forming with said pure copper in said crucible a molten copper alloy by a continuously loading into said crucible alloying material for admixture with said pure copper;

(c) passing a core-rod of said alloy through said crucible at a defined casting speed whereby said molten alloy crystalizes on the surface of said core-rod, and;

(d) regulating the rate at whch said alloying material is loaded into said crucible in correspondence to the casting speed of said rod to maintain said molten alloy at a given proportion of pure copper and alloying material, and thereafter working said crystallized rod to form said wire rod.

2. The process according to claim 1 including the step of maintaining said crucible under an oxygen free protective atmosphere.

3. The process according to claim 1 including the step of providing said alloying material in the form of a wire and driving said wire into said crucible.

4. The process according to claim 1 including the step of charging said alloy material into an annealed pure copper pipe and driving said pipe to said crucible.

5. The process according to claim 3 wherein said wire is driven at a linear speed of between 0.01 and 1.5 m/sec.

6. The process according to claim 4 wherein said pipe is driven at a linear speed of between 0.01 and 1.5 m/sec.

7. The process according to claim 1 wherein said working of said crystallized rod comprises the steps of cooling, hot rolling and subsequent coiling.

8. Apparatus for the continuous casting of a copper alloy rod, comprising a crucible, a furnace system for melting copper and continuously charging said crucible with molten copper, means for simultaneously loading said crucible with an alloy material to form with said molten copper, a molten alloy, and means for driving a core rod through said crucible for crystallization of said molten alloy thereon, said means for loading said crucible with said alloy being synchronized with said means for driving the core-rod to maintain in said crucible a copper alloy of given proportion.

9. The apparatus according to claim 8 wherein said means for loading said alloy material is variable to provide a linear speed of between 0.01 and 1.5 m/sec.

* * * * *